US010365068B2

(12) United States Patent
Ehrlich

(10) Patent No.: US 10,365,068 B2
(45) Date of Patent: Jul. 30, 2019

(54) DYNAMIC LASER MARKER DISPLAY FOR AIMABLE DEVICE

(71) Applicant: SMART SHOOTER LTD., Kibbutz Yagur (IL)

(72) Inventor: Avshalom Ehrlich, Kibbutz Ramat Hashofet (IL)

(73) Assignee: SMART SHOOTER LTD., Kibbutz Yagur (IL)

( * ) Notice: Subject to any disclaimer, the term of this patent is extended or adjusted under 35 U.S.C. 154(b) by 0 days.

(21) Appl. No.: 15/758,354

(22) PCT Filed: Jul. 20, 2016

(86) PCT No.: PCT/IL2016/050786

§ 371 (c)(1),
(2) Date: Mar. 8, 2018

(87) PCT Pub. No.: WO2017/042797

PCT Pub. Date: Mar. 16, 2017

(65) Prior Publication Data

US 2018/0292172 A1 Oct. 11, 2018

(30) Foreign Application Priority Data

Sep. 10, 2015 (IL) ..... 241445

(51) Int. Cl.

| | |
|---|---|
| ***G06F 19/00*** | (2018.01) |
| ***F41G 3/06*** | (2006.01) |
| ***F41G 1/36*** | (2006.01) |
| ***F41G 3/08*** | (2006.01) |
| ***F41G 3/12*** | (2006.01) |
| ***F41G 3/16*** | (2006.01) |

(52) U.S. Cl.

CPC ..... *F41G 3/065* (2013.01); *F41G 1/36* (2013.01); *F41G 3/08* (2013.01); *F41G 3/12* (2013.01); *F41G 3/16* (2013.01); *F41G 3/165* (2013.01)

(58) Field of Classification Search

CPC ... F41G 3/065; F41G 1/36; F41G 3/08; F41G 3/12; F41G 3/16; F41G 3/165; F41G 3/06; F41G 1/34; F41G 1/467

USPC ..... 235/404, 407, 411, 414

See application file for complete search history.

(56) References Cited

U.S. PATENT DOCUMENTS

2013/0130204 A1* 5/2013 Lim ..... F41A 33/02 434/22

2015/0345908 A1* 12/2015 Maryfield ..... F41G 3/06 356/152.1

(Continued)

*Primary Examiner* — Karl D Frech

(74) *Attorney, Agent, or Firm* — Mark M. Friedman

(57) ABSTRACT

A laser system operationally coupled to an aimable device having a Line of Sight (LOS), and adapted for providing a graphic laser display, including: at least one laser source adapted to generate: a first laser output, displaying a fixed pattern at a hit point having a fixed orientation relative to an axis of the LOS of the aimable device, and a second laser output, forming the graphic laser display; a motion control mechanism adapted to direct at least the second laser output; a tracking system configured to track at least one target; and a processing unit, configured to receive tracking data relating to a location of the at least one target relative to the LOS of the aimable device and instruct the motion control mechanism to direct the second laser output to display the graphic laser display on the at least one target.

20 Claims, 6 Drawing Sheets

(56) References Cited

U.S. PATENT DOCUMENTS

2018/0292172 A1* 10/2018 Ehrlich ..... F41G 1/36
2018/0347948 A1* 12/2018 VanCamp ..... F41G 1/30

* cited by examiner

Example of Laser Marker Drawings

DYNAMIC LASER MARKER DISPLAY FOR AIMABLE DEVICE

FIELD OF THE INVENTION

The present invention relates to an aiming device and, more particularly, to a laser aiming display that provides a remote visual marking.

BACKGROUND

Providing an aiming display for weapons (e.g. handguns, shotguns, assault rifles and as such) and other directional devices (e.g. binoculars, laser range finders, hyperbolic laser microphones etc.) is very challenging. Standard iron sights mounted on firearms require the user to hold the pistol at a certain level and focus on the sight instead of the target.

Reflector sights (otherwise known as "reflex sights" or "red-dot" sights) display a red dot (or other configurations or patterns) in the reticle of the sight. Reflex sights are very useful for rifles, but require the user to hold the firearm in a very narrow angle (in the line of sight—LOS) in order to see the red-dot. Reflex sights are even more problematic for short barreled weapons, as any small deviation from the LOS results in the user not being able to see the red-dot. There are also situations where neither iron sights nor reflex sights can be used, such as, for example, when using Night Vision Goggles (NVG). In such a scenario, a fixed laser marker is used for direct aiming at the target (e.g. an IR laser can be seen using NVG, without giving the user position away to the enemy).

Laser pointers are a well known shooting aid for weapons, providing a direct "hit location" marking i.e. the laser shows a specific, fixed location where the projectile will hit—but laser pointers cannot provide guidance and direction towards marked or locked (i.e. tracked) target locations that can be especially important in close combat situation.

In fact, this is not only a laser pointer problem, but rather a drawback of all types of weapon sights which direct the user to just one point that is aligned with the barrel of the weapon.

SUMMARY OF THE INVENTION

This invention solves the need for improved aiming sights (similar, for example, to "red-dot" or iron-sights) that are not obstructed or limited by the sight itself. The invention further provides a dynamic and intuitive visual display/marking that can be seen with both eyes open (even when using NVGs), and even from a distance and all the while keeping the focus on the target. Using the iron sights of a pistol requires the user's focus to move between the rear iron sight (having a V-like shape), the front iron sight and the target. The user cannot focus on all three points at the same time, as these three points are on different planes of focus (and very close to the user). The reflex sight solves the aforementioned problem but requires that the target be aligned (accurately) to the display, which is particularly difficult with a handgun given the limitations in size and weight.

The immediate system displays dynamic, remote markings which are easy for a user to see (much easier to see than a single dot of a laser sight, for example). The user has both eyes open, and the field of view is unobstructed. The large marking display is easy to see, even at a distance. Some features of the invention include: marking the potential/selected target, displaying a remote aiming guide that indicates how to adjust the firearm (or other device, both are generally referred herein as a 'workpiece' or 'aimable device') in order to shoot the selected target, as well as other functionality (for example: marking the targets for other people to shoot at, in the case of a team).

The invention is related to any weapons (pistols, shotguns, grenade launchers, usually hand-held, but can also be mounted on—and/or aimed by—a robot and the like) and not just for pistols. The invention can also be implemented on other directional devices (e.g. binoculars, laser range finders, hyperbolic laser microphones etc.) as well.

For example, in LRF, similar to shooting, but when the aimable device is "on target" a laser is projected exactly toward the target, giving an accurate measurement of the distance to the target although the user is shaking and/or the target is moving.

The range is known on a continuous basis in the sense that the target is tracked and any time the LRF is re-pointed at the target (exactly), the measurement will be taken. There is a further advantage when the range measuring component is connected to the geographic positioning component, exact coordinates are extracted. So you further achieve the goal of updating the target location with each measurement.

According to the present invention there is provided laser system operationally coupled to an aimable device having a Line of Sight (LOS), the system adapted for providing a graphic laser display, the system including: (a) at least one laser source adapted to generate: (i) a first laser output, the first laser output displaying a fixed pattern at a hit point having a fixed orientation relative to an axis of the LOS of the aimable device, and (ii) and a second laser output, the second laser output forming the graphic laser display; (b) a motion control mechanism adapted to direct at least the second laser output; (c) a tracking system configured to track at least one target; and (d) a processing unit, the processing unit configured to receive tracking data relating to a location of the at least one target relative to the LOS of the aimable device and instruct the motion control mechanism to direct the second laser output to display the graphic laser display on the at least one target.

According to further features in preferred embodiments of the invention described below the at least one laser source further includes a second laser source, wherein the second laser output is generated by the second laser source. According to still further features the motion control mechanism controls motion of the second laser source. According to still further features the system further includes a mirror, the mirror directed by the motion control mechanism to reflect at least the second laser output to form the graphic laser display. According to still further features the processing unit further instructs the motion control device to direct the mirror to reflect the first laser output to display the laser dot hit point.

According to still further features the system further includes a beam splitting mechanism, the beam splitting mechanism adapted to split a laser output from the at least one laser source into the first laser output and the second laser output. According to still further features the tracking system includes: an imaging device and an imaging processor. According to still further features the imaging device captures images of a Field of View (FOV) of the imaging device and the imaging processor is configured to process the images so as to generate the tracking data relating to the at least one target in the FOV.

According to still further features the processing unit is configured to calculate a range to the at least one target by calculating a difference between a movement angle of the motion control mechanism for each pixel of one of the images. According to still further features the system further includes a laser receiver for the second laser output, the laser receiver adapted to measure a distance between the aimable device and the at least one target. According to still further features the tracking system is zeroed to the LOS of the aimable device at the distance measured by the laser receiver.

According to still further features the first laser output is selected from the group including: a laser having a first visible color, a near infrared laser and an infrared laser; and the second laser output selected from the group including: the laser having the first visible color, a laser having a second visible color different from the first color, a near infrared laser and an infrared laser.

According to still further features the processing unit is further configured to calculate a target area within the at least one target, such that a projectile discharged when aimed at the target area will hit the at least one target.

According to still further features the aimable device is selected from a group including: a hand-held weapon, a hand-aimed weapon, a shoulder-mounted weapon, a robot mounted weapon, robot aimed devices, binoculars, view-enhancing optics, night-vision optics, laser range finders and hyperbolic laser microphones. According to still further features the graphic laser display further indicates an aiming correction that needs to be made in order for the LOS of the aimable device to coincide with the location of the at least one target tracked by the tracking system.

According to still further features the graphic laser display displays elements selected from the group including: boundaries of the at least one target, additional user information, a predetermined graphic indicating friendly forces, navigational instructions. According to still further features the graphic laser display is calculated taking into account ballistic correct of a projection fired from the aimable device.

According to still further features the at least one laser source further includes an additional laser source, wherein the at least one laser source and the additional laser source are adapted to output laser beams selected from the group including: visible laser beams, Infrared laser beams and Near Infrared laser beams and wherein the laser sources are selectably interchangeable. According to still further features the tracking system includes motion sensors providing motion data relating to motion of the aimable device According to still further features the system further includes an indicator indicating whether the LOS of the aimable device coincides with the location of the at least one target tracked by the tracking system. According to another embodiment there is provided a fire-control system, for an aimable device, the fire-control system including: (a) the aforementioned aiming system, and (b) a firing-control mechanism, controlled by the aiming system.

BRIEF DESCRIPTION OF THE DRAWINGS

Various embodiments are herein described, by way of example only, with reference to the accompanying drawings, wherein.

DESCRIPTION OF THE PREFERRED EMBODIMENTS

Figure 1A:
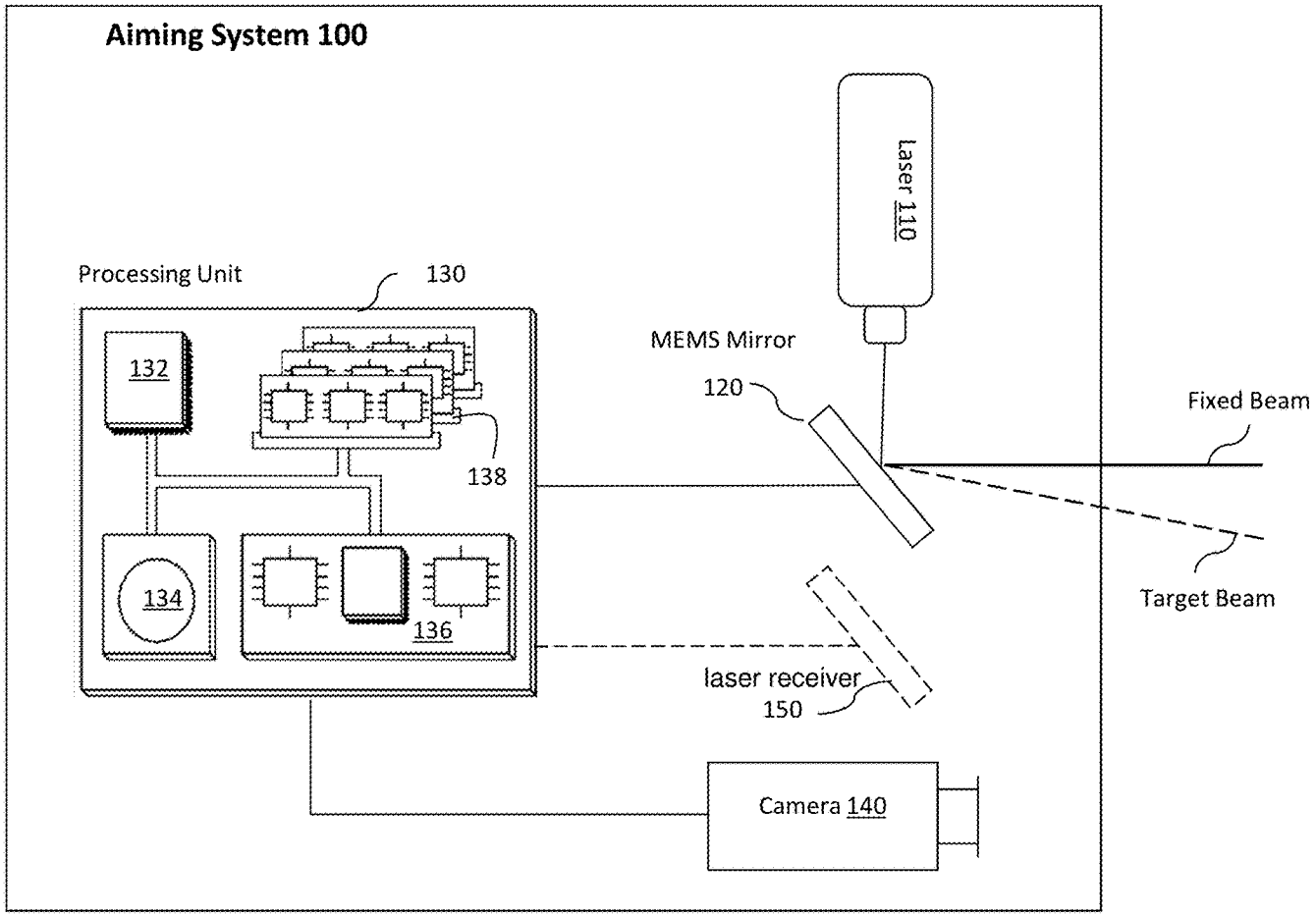
FIG. 1A is a block diagram of an exemplary aiming system of the immediate invention.

Some of the terms used herein may be seen as ambiguous and therefore confusing. Some of these terms are explained and expanded here, to ensure clarity. The explanations are not intended for the purpose of limiting the terms in any way but rather to simply clarify their meaning.

"Laser light", "laser beam", "illumination beam", "laser pulse(s)", "laser output" and variations thereof refer to the light emitted by a laser source or other light source. The emitted light may be a beam or pulse or other form of emission—generally referred to herein as "laser output". In some places, the term laser actually refers to the beam or light produced by the laser, not the device itself. Although care has been take to avoid any confusion.

"Laser", "laser marker", "laser display device", "remote marking device" and combinations and/or variations thereof refer to a laser device that emits a visible laser marking on a remote location. A laser is a device that emits light through a process of optical amplification based on the stimulated emission of electromagnetic radiation. The laser marker of the immediate invention does not merely display a red dot like a laser sight does but rather a more descriptive marking (which is formed by the laser output being directed from one point to another at such a speed that the human eye perceives an image, not a collections of dots) which guides the user—as will be discussed in greater detail below. The word "remote" comes to distinguish from a laser marking on the aiming device itself, as is the case with a reflex sight discussed above.

"Aiming display", "laser marking", "remote marking", "guidance display", "laser graphics", "scanning" and variations thereof refer to the picture, image or laser display that is created when the laser beam hits a remote surface. There are two types of laser markings relevant to the immediate invention:

(a) "Fixed point laser output", "laser dot hit point"—refers to a laser marking that is fixed to the LOS of a weapon or other aimable device, and designates the approximate hit point or hit location of the weapon. This is generally visible as a laser dot or spot.

(b) "Multi-point laser output", "dynamic laser output" and variations thereof refer to a laser marking that originates from a single source but displays multiple points which appear to the human eye as a single picture (similar to a laser display that spells out a word). The marking is a result of the beam being very rapidly projected or reflected at different points. Movement between the points is so rapid that the human eye perceives the markings as a single image (similar to the 'scanning effect' in a cathode ray tube (CRT) television or computer screen).

"Line-of-sight (LOS)" of an aimable device refers herein to the straight line between the aimable device and a first non-transparent object, along the axis defined by the bore of the muzzle or the lens of optics. Laser sights which are known in the art project a laser beam that has a fixed orientation, relative to the axis of the LOS of the aimable device. The result is that a laser dot appears on the first intervening surface in the LOS of the aimable device (usually a firearm) where the laser dot denotes the approximate "hit point" where a projectile from the weapon would hit, if fired.

"Hit point", "aim point", "hit location" and variations thereof refer to the estimated location where a weapon (or other aimable device) is pointed, and where the weapon will hit if fired.

"Target location" and variations thereof refer to the point or area on the target object that the user wishes to hit.

Overview

The present invention discloses an innovative system for guiding the use of a firearm or other aimable device (e.g. binoculars, a laser range finder etc.) by employing two separate laser beams or 'types' of laser outputs. The first laser output is a regular "fixed" laser marker that is fixed or zeroed to the direction of the barrel of the weapon. The fixed point laser output indicates where the projectile will hit, when shot from the weapon (e.g. a laser dot visible on the hit point). The second laser output is a dynamic laser marking that provides a graphic laser display that directs the user how to adjust the weapon in order to hit the target. The system tracks the target and instructs the laser (or mirror) to "draw" a laser marking to assist the user in properly aiming the weapon. The laser display is drawn on a remote surface near or on the target.

Figure 4:
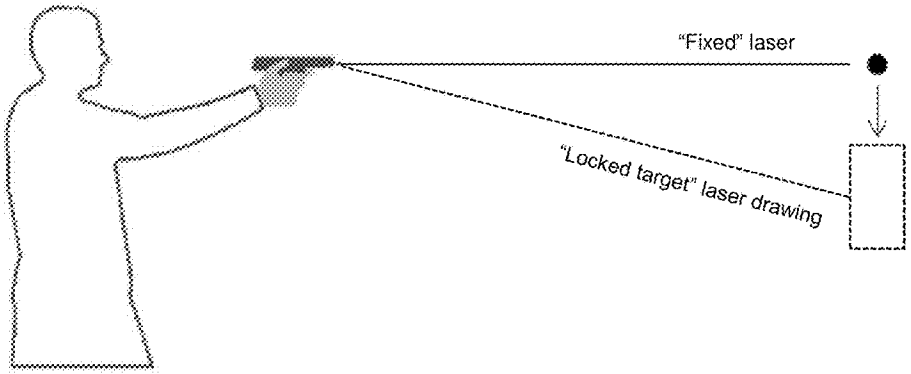
FIG. 4 is a simplified, pictorial depiction of the immediate invention employed in an exemplary aiming scenario.

Referring briefly to FIG. 4, the Figure illustrates a simplified pictorial depiction of an exemplary embodiment of the immediate invention, as employed in an exemplary aiming scenario. The fixed laser output is pointed in the direction of the firearm (i.e. along, or at least parallel to the axis of the barrel of the firearm), which, in the illustration, is not pointing at the target. The fixed point laser output terminates in a fixed pattern, usually a "dot", at the remote location. At the same time, the dynamic laser output is focused on the target. In the illustration, the dynamic laser output forms a rectangular display on the target. Additionally, the dynamic laser output also draws a guiding marking (in the figure, the exemplary guiding marking is an arrow) which instructs the user how to adjust his aim in order to hit the target. FIG. 4 will be discussed at length below.

Basic Components

The basic components of the invention include the following elements: (1) at least one laser device producing (a) a fixed point laser output; and (b) a dynamic or multi-point laser output; (2) a motion control system (e.g. Galvanometer mechanisms, MEMS, etc.) for directing the laser output (directly or indirectly); (3) a tracking system for tracking the target(s); and (4) a processing unit for controlling the operations of the system.

Figure 1B:
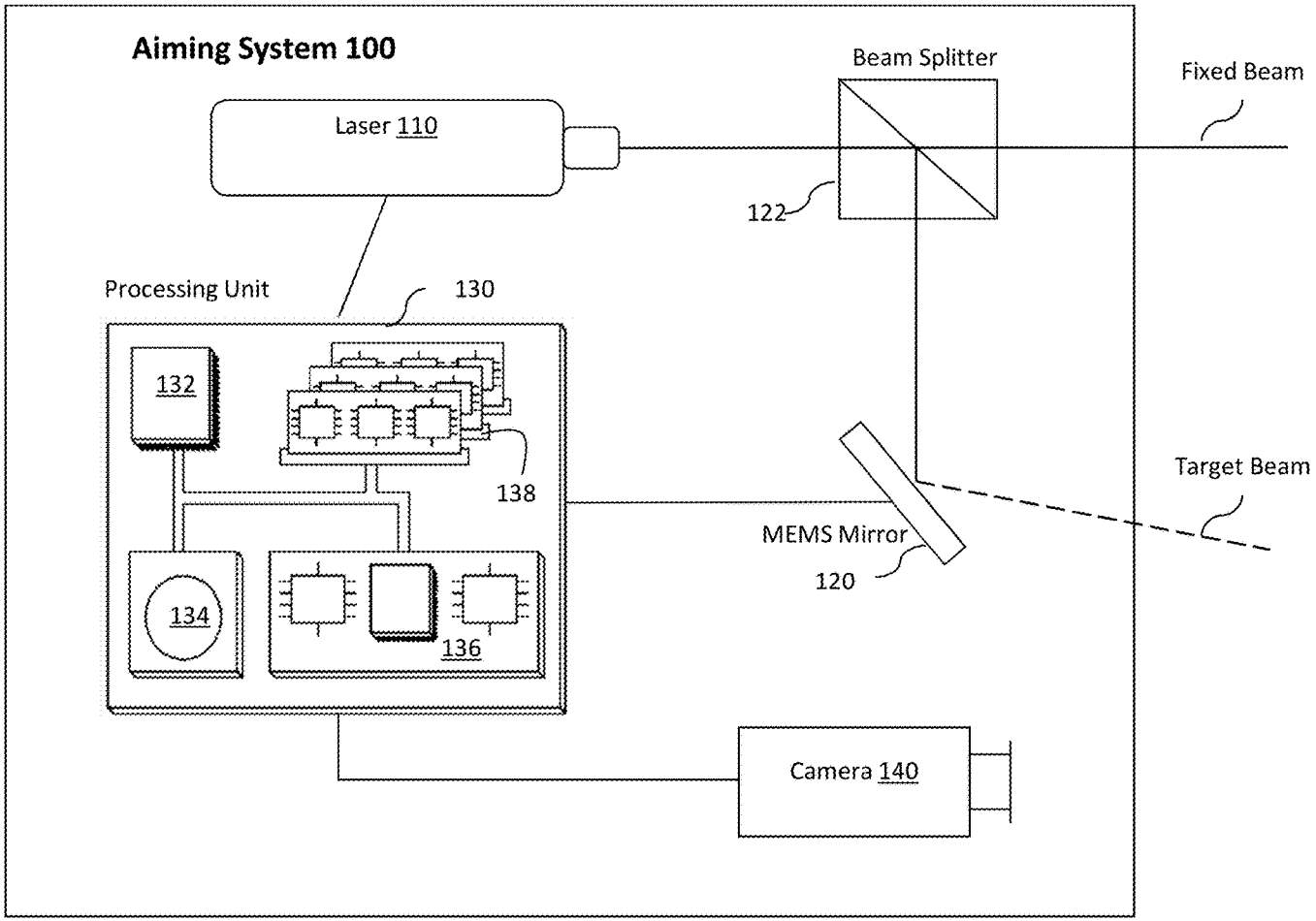
FIG. 1B is a block diagram of an alternative embodiment of the system, further including a beam splitting element/mechanism.
Figure 2:
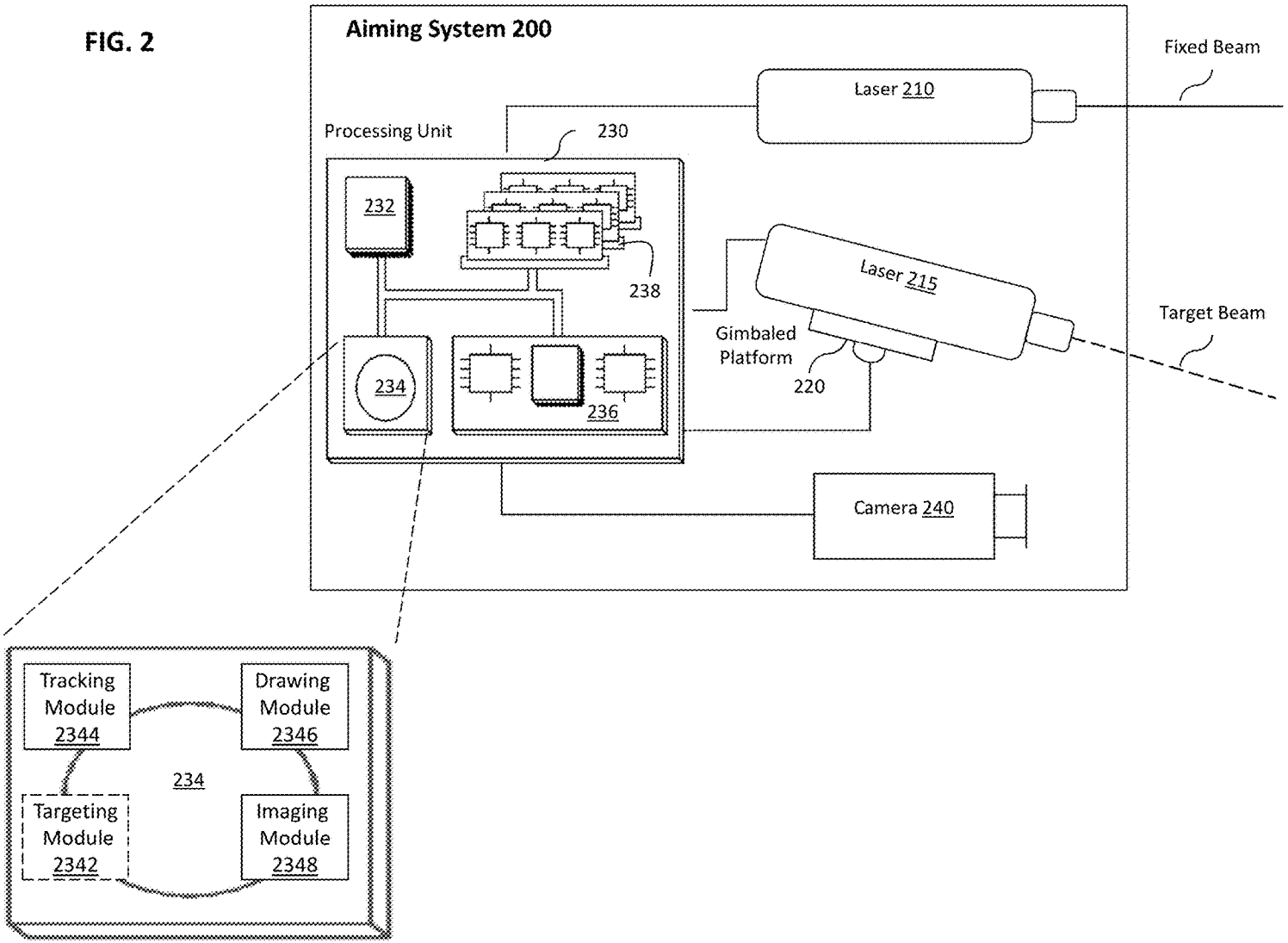
FIG. 2 is a block diagram of another exemplary aiming system.

The fixed-point and multi-point laser outputs can be generated by a single laser source (see FIG. 1A, 1B) or by two separate laser sources (see FIG. 2). The motion control system controls (at least) the platform that directs the dynamic laser output. For example, if the dynamic laser output is directed using a MEMS mirror (see FIG. 1A, 1B), then the motion control system controls the movement of the mirror. In another example, if the dynamic laser output is generated by a separate, dedicated laser device (e.g. see FIG. 2, 3), then the motion control system controls the movement of the dedicated laser device.

The tracking system includes a camera or other imaging device and an image processor. The image processor can be part of the processing unit or separate there-from. Either way, the processing unit employs the tracking data to generate the display markings. In fire-control systems, the processing unit further controls (directly or indirectly) the firing mechanism of the weapon.

The processing unit may be a single microcontroller or a series of microcontrollers configured to use the laser outputs to show the user where the weapon is currently aimed and how and to where the weapon aim must be corrected.

The laser marker display system can be a standalone device or can be part of a larger fire-control-system. The standalone device on a weapon, for example, produces a graphical display that allows the user to focus on the real-target with both eyes open and/or while using NVGs, without having to use any other optics (e.g. scopes, iron sights, etc.) or display. In some embodiments, the laser marking enables other nearby users, forces, soldiers, team-members etc. to see the marked/locked targets. The standalone device can also be implemented in other aimable devices such as binoculars for designating targets, and the like.

In a larger fire-control system, the firing mechanism of the weapon is only enabled or actuated when the system processing unit (e.g. onboard computer) calculates that the target will be hit. Generally, the most critical factor is the movement of the shooter (or more precisely the weapon held by the shooter) and thereafter the target movement. The system compensates for the aforementioned factors (user and target movement) by tracking the target and/or the background. For long-range weapons (e.g. a sniper rifle), various environmental factors such as range, wind factor, ballistics etc. are also taken into account.

The principles and operation of a dynamic laser marker display device, according to the present invention, may be better understood with reference to the drawings and the accompanying description. At the outset, it is made clear that the following embodiments do not encompass the entire scope of the invention, such that various modifications, combinations and substitutions of the elements described below are considered to be within the scope of the invention.

Option I

Referring now to the drawings, FIG. 1A is a block diagram of an exemplary aiming system 100 of the immediate invention. Aiming system 100 includes a single illumination source, shown here as laser 110. System 100 further includes a motion control system, referred to also as a directing apparatus 120. In some embodiments the system further includes a tracking system. The tracking system includes a camera or other imaging device 140 and an image processor. The imaging device is zeroed to the LOS of the aimable device, so that the tracking system knows the hit location of the aimable device, i.e. where the aimable device is pointing.

In one embodiment, the aimpoint of the imaging device is set to a fixed range. In some embodiments of the system, the system further includes a laser range finder (LRF) laser receiver 150. The laser receiver allows the dynamic laser to function as a laser range finder as well. With this additional function, the system is able to determine the range to the target. In such embodiments, the aimpoint can be adjusted according to the measured range to the tracked target.

The imaging device captures images of a Field of View (FOV) of the imaging device and the imaging processor processes images from camera 140 in order to lock onto target(s), detect target(s) and/or recognize objects as targets. One or more targets can be tracked by the tracking system.

Alternatively or additionally, the system may be an "inertial system" whereby a non-moving target is tracked by motion sensors (e.g. gyros) such as described for FIG. 3 below. In one embodiment, the inertial system is in addition to the imaging tracking system. In another embodiment, there is no camera or imaging system and the target is tracked solely based on motion sensors. The inertial system includes motion sensors which detect and compensate for the involuntary and unwanted movement of the shooter/user holding the aimable device. Even though the user's hand moves, the motion sensors compensate for the movement and display/tracking system remains locked on the target.

System 100 also includes a controlling unit, also referred to as a processing unit 130 (e.g. a computer), which controls the "drawing" function of the system that creates the guidance markings with the laser. The type and complexity of the controller (e.g. microcontroller, processor, processing unit etc.) depends on whether the device is a standalone device or part of a fire-controlled-system providing guidance for aiming a weapon at locked targets. The standalone device is an "advanced laser pointer" for firearms. The firing-control system, as the name suggests, further controls the firearm's ability to discharge the weapon.

The processing unit controls generation of the laser markings based on three parameters: (1) where the amiable device is currently pointing, (2) the position of the target (and more precisely the hit location of the target) and (3) the direction (and in some cases distance) between the first and second parameters.

In the immediately depicted embodiment, laser 110 produces two separate laser markings. The first laser marking is referred to as a "fixed hit location", "fixed-point laser marking" or "laser dot hit point" which shows where the weapon is directed (parameter 1). The marking is usually a red dot (or other color) which is displayed on the "hit location" (i.e. the point where the weapon is currently aimed).

The second laser marking is the "dynamic laser marking" or "guidance marking" or "multi-point laser marking" which is the guidance display that shows the user how to correct the aim of the weapon in order to hit the target (parameter 3). In preferred embodiments, the marking also "marks" the hit location of the target. In the system of FIG. 1A, the fixed and dynamic markings are generated from a single laser output which is steered or directed by directing apparatus 120 which, in the depicted exemplary embodiment, is a Micro Electro-Mechanical Systems (MEMS) mirror. Scanning two axis (tip-tilt) MEMS mirror (or "micromirror") is an optical beam-steering (or 2D optical scanning) technology known in the art. The tracking system is discussed in further detail below, with reference to FIG. 2.

FIG. 1B is a block diagram of an alternative embodiment of the system of FIG. 1A, further including a beam splitting element/mechanism. In the exemplary embodiment depicted in FIG. 1B, a beam-splitter 122 splits the beam from the single laser source into two distinct outputs, before the light exits the device. The first laser output is referred to as a "fixed beam" which shows where the weapon is directed, usually displaying a red dot on the "hit location". The beam is referred to as "fixed" because it is fixed to the orientation of the barrel of the weapon and zeroed (calibrated) to the LOS/aim point of the weapon.

The second beam (whether from the same laser source as the fixed laser or from a separate laser source) is referred to as the "target beam". The second laser output forms the guidance display/graphic laser display that shows the user how to correct the aim of the weapon. In order to hit the target. In the depicted embodiment, the beam (or pulse or other variation of laser output) is reflected off a MEMS mirror 120 which directs the beam to form the display.

Different color laser beams can be used (e.g. green and red). The laser beams may have a visible wavelength, may be Near Infrared (NIR) or Infrared (IR). The latter beam is only visible to special optics such as NVGs and the like. The system may include more than one type of laser. In some cases different lasers can be alternatively selected by the user (or automatically selected). Being able to select a type of laser is very useful. For example, during the day, the user may prefer to use a visible laser whereas at night an invisible laser (such as an IR laser that can be seen using night-vision gear) would be preferable, so that the beam does not reveal the shooter.

Referring to both FIGS. 1A and 1B, processing unit 130 is exemplarily depicted as having a processor 132, a storage medium 134, an input/output component 136, and a memory 138. Memory 138 generally includes any type of non-volatile memory. Each of the components 130, 132, 134, 136 and 138 are interconnected by a system bus. The processor 132 is capable of processing instructions for execution within the system 100. In one implementation, the processor 132 is a single-threaded processor. In another implementation, the processor 132 is a multi-threaded processor. The processor 132 is capable of processing instructions stored in the memory 138 or on the storage device 134 and controlling the laser, mirror and camera according to those instructions, e.g. via input/output component 136.

The memory 138 stores information within the system 100. In some implementations, the memory 138 is a computer-readable medium. The storage device 134 is capable of providing mass storage for the system 100. In one implementation, the storage device 134 is a computer-readable medium. In various different implementations, the storage device 134 may be a solid state drive, a hard disk device or some hybrid combination of the two.

Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks.

The processor and the memory can be supplemented by, or incorporated in, ASICs (application-specific integrated circuits).

The input/output component 136 interfaces between the processing unit and the other components such as the laser, mirror and camera. In one implementation, the input/output component 136 interfaces with user controls on the aiming system and/or the aimable device.

The features described can be implemented in digital electronic circuitry, or in computer hardware, firmware, software, or in combinations of them. The apparatus can be implemented in a computer program product tangibly embodied in an information carrier, e.g., in a machine-readable storage device, for execution by a programmable processor and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device.

A computer program, referred to also as a module or software module (see below with reference to FIG. 2), is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data.

Option II

Another possible configuration is shown in FIG. 2. FIG. 2 is a block diagram of another exemplary aiming system 200 of the immediate invention. As with FIGS. 1A and 1B, the aiming system may be a standalone system or part of a fire-control system. Aiming system 200 includes two lasers, a directing apparatus 220, an imaging device 240 that is part of a tracking system (described in detail here-below) and a controlling unit 230 (or computer) for controlling the laser "drawing". The first laser is a fixed laser 210 and the second laser is a target laser 215. The target laser is mounted on the directing apparatus 220 which is a movable or kinematic platform that is controlled by controlling unit 230. Exemplarily, the directing apparatus is a gimbaled platform 220, as depicted in the Figure.

Controlling unit 230 is exemplarily depicted as having a processor 232, a storage medium 234, an input/output component 236 and a memory 238. Memory 238 generally includes any type of non-volatile memory. The components discussed here are substantially equivalent to those discussed above with reference to FIGS. 1A and 1B.

The first laser 210 needs to be zeroed to the weapon so that the axis of the laser is parallel to the axis of the LOS of the aimable device (e.g. parallel to the axis of the barrel of the firearm) so that the aim point of the laser and the aim point of the weapon are substantially the same point. The first laser output is pointed in the same direction as the weapon and may or may not be pointing at the target. The target laser draws the graphical guidance display discussed above. In order to generate the display, the target must first be tracked. Camera 240 is part of a tracking system that detects objects and recognizes them as targets. The target or targets are then tracked by the system.

As above, in some embodiments the tracking system may include an inertial system in addition to the imaging tracking system while in other embodiments, there is no camera or imaging tracking system but only an inertial system with motion sensors. In the latter embodiment, the system only tracks static targets. The motion sensors track the (unwanted) movement of the barrel/aimable device, and compensate for that movement to stay locked on the target.

Tracking System

Although reference is made to the aiming system of FIG. 2, it is made clear that the following description regarding the tracking system (and all other relevant systems and components) refers equally or equivalently to the other embodiments described beforehand and hereafter.

In one preferred embodiment, the tracking system includes an imaging device (e.g. an image sensor, camera 240 or other imaging device) and an imaging processor (e.g. image processing module 2348 or even a standalone imaging processor).

As above, in some embodiments the tracking system may include an inertial system in addition to the imaging tracking system while in other embodiments, there is no camera or imaging tracking system but only an inertial system with motion sensors. In the latter embodiment, the system only tracks static targets. The motion sensors track the (unwanted) movement of the barrel/aimable device, and compensate for that movement to stay locked on the target.

Referring back to the imaging system, the image processing module and imaging processor serve one and the same function and are referred to interchangeably. Camera 240 can be a day/night video camera, for example a charge-coupled device (CCD) or CMOS; forward looking infra-red sensor (FLIR); multispectral or hyper-spectral camera, or any other sensor that enables tracking of a target location in their field of view (FOV) including combinations thereof. In this regard, the imaging system may "fuse" data from more than one sensor into one or more representations or use the different inputs in parallel.

Imaging device (camera) 240 (as mentioned, this relates equally to imaging device 140) captures images within the field of view (FOV) of the device. In some embodiments, image processing software (referred to herein as Imaging Module 2348), embedded in the processing unit, processes the images to determine distinct objects (e.g. using edge detection techniques) in the FOV and recognizes whether the objects are targets, potential targets or background. In other embodiments, the target(s) are simply tracked by the processing unit.

Movement of a target can be calculated using various processing algorithms and methods, including, but not limited to, movement relative to one or more static background features (e.g. objects or structures, such as a building, rock, tree or the like) in an imaged field. In such case, the firearm need not include a barrel motion sensor, and the one or more static features ("anchor" features) can be used by the imaging system to determine movement and angular velocity of the target. In the fire-control system, comparing the location of the target relative to anchor features in successive frame "lead" data for use by the processor's tracking and/or firing algorithm. Further, the static background features can be used for determining the barrel movement (or movement of the aimable device, related to the natural human condition where the hand holding the aimable device moves or shakes). In some embodiments, the imaging system is adapted to determine the movement of a potential target based on movement relative to one or more dynamic background features. The system can use movement detection, IR detection (e.g. 37° C.) and the like for locking on to a potential target or for shooting at a target even without locking.

In one embodiment, the aiming system tracks all targets in the FOV of the imaging device (whether the targets are moving, or the weapon or both). In other embodiments, only a single target is actively tracked at any given time by the system, e.g. when the aimable device is pointing at or near the target.

The imaging system is zeroed to the direction of the amiable device. Therefore, the processing unit calculates the fixed hit point of the weapon, based on the data received from the imaging system. As mentioned above, the imaging system detects and distinguishes targets. In some embodiments, once a target is detected by the imaging system, an Automatic Target Recognition (ATR) Module 2344 recognizes the type of target (e.g. a person or vehicle) and determines a target "hit area" based on the type of target. For example, the usual target hit area of a person is the center mass of the upper torso. The target hit area of a wheeled vehicle, for a light arm, is the wheels. In all embodiments, data regarding the target's position (and in some instances, a specific target hit area) is communicated to the central processor.

The processing unit receives all of the above data and a Drawing Module 2346 instructs the laser(s) and/or mirror and/or additional optics (not shown) to draw the desired markings for both the fixed hit point and target guidance marking.

In the embodiment where the aiming system is part of a larger fire-control system, once the target is detected, it may be selected, e.g. using dedicated user controls (not shown). A selected target is also referred to as a locked-on target. Once the system locks onto a particular target, a Targeting Module 2342 calculates where the weapon needs to be pointing in order to hit the target. The fire-control system, in an automatic mode, only enables or instructs the weapon to fire when the weapon is pointing at the predetermined point or area.

The targeting, ATR and drawing modules include computer-readable instructions and are stored in non-volatile storage medium 234. The instructions are uploaded into memory 238 and processed by processor 232 which instructs the various component to carry out the computer-readable instructions.

Figure 3:
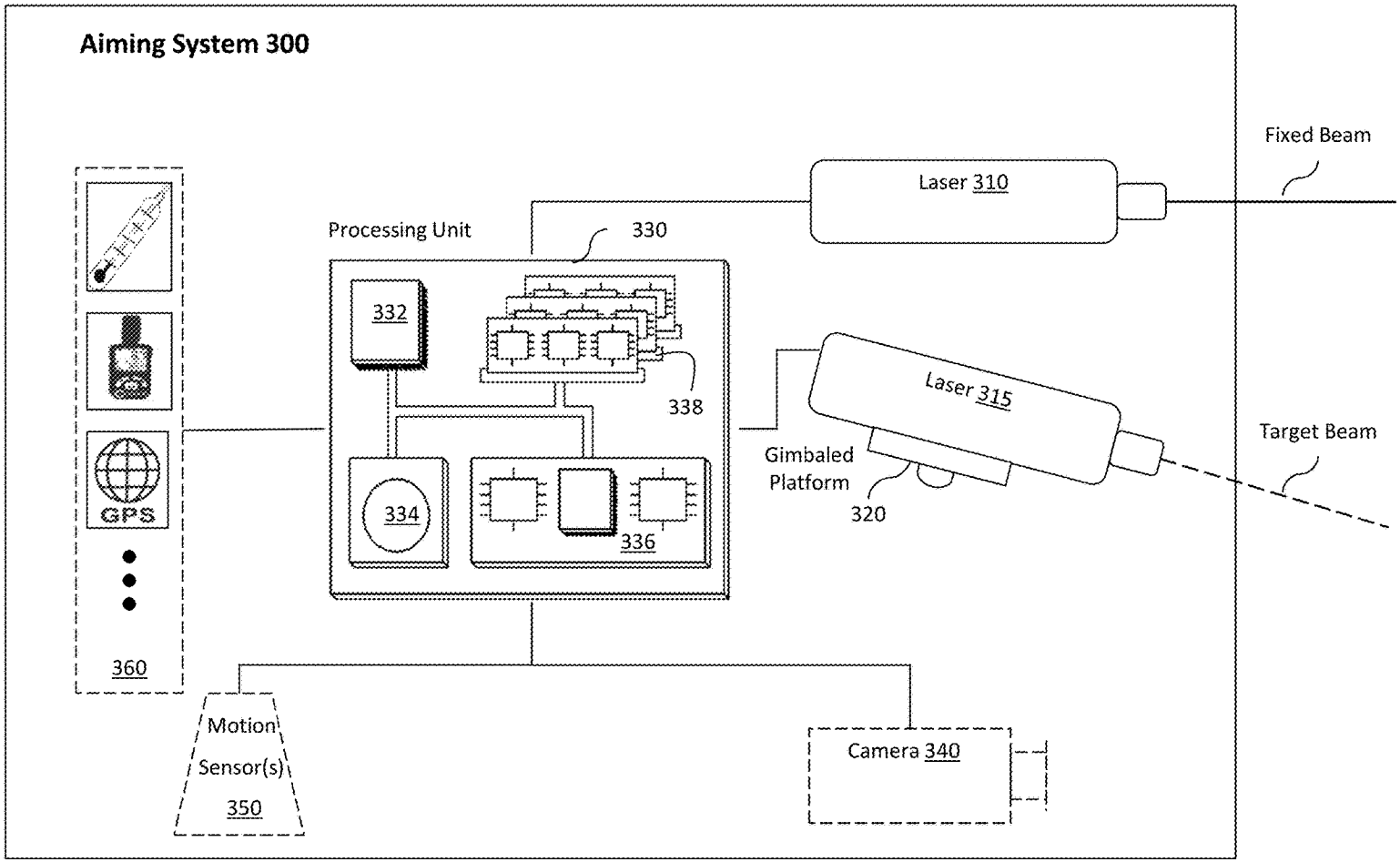
FIG. 3 is a block diagram of another exemplary aiming system.

Yet another configuration is shown in FIG. 3. FIG. 3 is a block diagram of another exemplary aiming system 300 of the immediate invention. The depicted system is similar to the system of FIG. 2 but further including additional optional or alternative components. The system of FIG. 3 is especially suited for long-range weapons and/or as part of a fire-control system.

Calibration and/or stabilization functions can be accomplished with optional motion sensors 350. Additionally, the motion sensors can be used to track static targets. That is to say that the motion sensors are used for stabilizing the laser drawing display in the real world. For example, the motion sensors can provide motion data regarding the movement of the barrel/hand that is holding the workpiece and this data is used by the computer to eliminate the affects of these movements of the user on the laser drawing. Alternatively, the motion sensors can be used instead of camera 340 as the only tracking element in the system. In general, aim system 300 can be part of either a standalone device or a more encompassing firing-control-system.

A non-limiting list of exemplary barrel motion sensors include: gyroscope and compass based sensors, inclinometers and accelerometers. One or more of these additional sensor components can be included in either the standalone device or, more commonly, in the larger firing-control system. Further additional, optional components can include additional sensors 360 for sensing and measuring values such as: inclining angle, wind, air-pressure, temperature, location etc. (e.g. barometer, thermometer, digital compass, GPS, etc.).

In some embodiments aiming system 300 can include additional sensors 360, such as the following components: microphone; inclinometer; accelerometer/inertial sensor; compass; GPS, Laser Range Finder (LRF), temperature measurement device (e.g. thermometer, thermocouple); barometer; wind-meter; and other like. (As discussed above in relation to FIG. 1B, the system can include a laser receiver and a laser range finder module for calculating the distance to the target. In such a can, the dynamic laser functions as an LRF itself) Such components can be added to aiming system 300 to improve the accuracy and compensate for environmental factors that affect firing accuracy; to provide intelligence, e.g. a geospatial information system (GIS) and GIS data base, which may include capability for determining user location and user location with respect to friendly and unfriendly forces; and for event recording purposes.

In the embodiment where the aiming system 300 is part of a firing-control system (FCS) further includes a firing processor (not shown), which comprises a firing computer; in preferred embodiments, an epsilon logic module; and a firing decision module. A firing computer is a typical component on sophisticated aiming systems and performs activities such as calculating the adjusted aim-point to the required range, wind, inclining angle etc; and typically uses ballistics tables and/or equations of the specific firearm and rounds. Firing decision module is responsible for taking input from other systems/modules/processors and predicting whether the target can be hit. For example, in the immediate invention, when the fixed beam coincides with the target beam then the FCS enables/actuates firing, In preferred embodiments, this prediction, or more precisely the actual hit, is aided by use of a target area, called an "epsilon tolerance area" (or derivations of this term).

FIG. 4 illustrates a simplified, pictorial depiction of the immediate invention employed in an exemplary aiming scenario. In the simplified illustration, a fixed laser beam is pointed along the LOS of the firearm which, in the illustration, is not pointed at the target. The fixed laser beam (which is not usually visible to the naked eye) usually terminates in a visible dot. The first laser beam (or pulses) is referred to elsewhere herein as the first/fixed laser output. The laser dot is referred to elsewhere herein as a marking that displays the laser dot hit point (of the weapon).

A second beam points in the direction of graphical laser display. The second laser beam is referred to elsewhere herein as the second/dynamic laser output. The graphical laser display includes a target marking and a guidance marking. The target marking marks the preferred hit location on the target. The target hit location marking can be as big or as small as desired or as relevant. For example, if the target is very near to the weapon and/or relatively small in size then the marking can be a small circle or dot. If the target is far away or large enough to include a bigger potential target area then the marking can be a larger circle or a plurality of concentric circles, cross hairs, etc.

The guidance marking is an image that shows the user, with a visible sign, how to aim the weapon so that it is correctly pointing at the target. The guidance marking can be an arrow or some other directional marker. In some embodiments, the guidance markings can be directed towards more than one detected and/or selected and/or locked targets. For example, the dynamic laser output can draw a number of lines, one line from the current aim-point to each of the targets, In some embodiments, and especially for fire-control systems, the target marking includes the target's "epsilon". The term "Target Epsilon" is used herein to refer to an area of the target that, when the weapon is correctly pointing at a point within this area, the weapon is allowed (by the fire-control system) to shoot/discharge. The target "epsilon" may include, for example, 80% of target contour. In a regular system that is not a target control system, the target marking (or epsilon marking) can change when the weapon is aimed at a point within the target epsilon. For example, the target epsilon can be displayed as an ellipse when the weapon is not aimed at a point within the epsilon area, and then change into cross hairs or an X when correctly aimed. In some embodiments, the color of the display can change (e.g. from green to red), when the weapon is correctly aimed.

Range is one of the factors for determining the target epsilon. The closer the weapon is to the target, the larger the epsilon area. In one embodiment, range can be measured using the laser pointer and camera. One method of calculating range is by calculating the difference between the movement angle of the laser or MEMS mirror for each pixel of the camera image. Another method for range calculation is to calculate the parallax between the laser (as seen by the camera) and the camera (like a coincidence rangefinder). Using a second laser beam enables the system to measure range from the workpiece to the target, even if the target is not in the LOS of the workpiece (firearm, binoculars etc.). Another method of converting the dynamic laser into a LRF has been discussed above.

Alternatively or additionally, distance to the target can be measured with an additional Laser Range Finder (LRF) and/or by image processing which can, for example, identify a nearby object with a known size, and calculate the distance to the object based on the difference between the imaged size and the known size of the object.

It is noted that the fixed laser beam (aim-point) may be projected to infinity and may not be seen, while the "drawing" (laser marking) on the target relevant ranges) is intended to be seen at all times. It is still possible to draw on any seen object, even on dynamic ones.

The fixed laser beam displays the current aim-point of the firearm just like a regular firearm laser pointer. Innovatively, the present system can electronically calibrate the laser location. For example, the MEMS minor can be calibrated or zeroed to direct the first laser output to the aim point of the weapon.

Further innovatively, the system can adjust the pointer location to the shooting scenario at least in the following way: the aiming system can vertically adjust the pointer location to take into account a ballistic correction. The ballistic correction can be based on the specific target range and/or inclining angle. In other embodiments, the correction can further take into account other possible factors such as air pressure, temperature, bullet type and the like.

An additional feature of the immediate system is the ability to 'highlight' a potential target or a locked-on target. The term 'highlight' is used herein to refer to a laser beam marking that designates the target. For example, the beam may highlight the boundaries of a target or 'draw' a box or circle on the target. The target (whether a potential target or a locked target) is recognized or detected by the camera and the computer and the processing unit directs the target laser to highlight the target boundaries. The laser display can highlight the contour of the target (e.g. in the dark, the system highlights the outline of the figure, so that the user, or other people, can visibly track the target in the dark). Other highlighting options include highlighting around the target, instead of the exact contours of the target or highlighting an internal contour of the target, e.g. highlighting 80% of the entire target volume.

Additional Applications

The immediate system does not require an optical "sight" or screen but can be combined with a regular LCD and/or projected sight. The system allows the user to project the laser marking onto the target and aim the firearm based on the marking(s). The task of the user is to bring the fixed laser dot to the locked target hit location marking or "fire-enable area" (such as where movement is detected). In some embodiments, as mentioned elsewhere, the laser(s) may be selectable between visible and IR/NIR.

The present system can be combined with a 2D-LRF (laser range finder. The laser reflection is received by a laser receiver and time of flight is measured in order to calculate the range to a target in the field of view of the laser and not just in the line of sight of the weapon.

The system can be employed to display additional user information. Some examples include: displaying the system status (e.g. battery status), whether a target is locked or not etc. The system can be used to identify forces (e.g. by drawing an 'X' marking on friendly forces in sight of the weapon or accidentally locked-onto by the targeting module). Of course, this application requires integration of a 'friend or foe' system.

The system can be used to display navigation instructions, such as drawing arrows on the ground, directing the user to the next navigation point; or drawing the north direction so that a compass does not have to be consulted. Further applications include writing the street name and/or house number etc. Of course, this application requires location sensors such as a OPS, digital compass inclinometer and/or other motion sensors.

In some embodiments, the system includes an indicator (e.g. a simple LED indicator) on the device to assist the user in scenarios where the laser marking on the target cannot be seen, such as far away targets, bright targets etc. The indicator informs the user whether or not a lock has been achieved or shooting has been enabled (i.e. in a fire control system where the trigger only works when shooting has been enabled by the system).

In another configuration, the laser system is combined with a zoom lens/telescope to enable the user to see the laser at an extended range.

Figure 5:
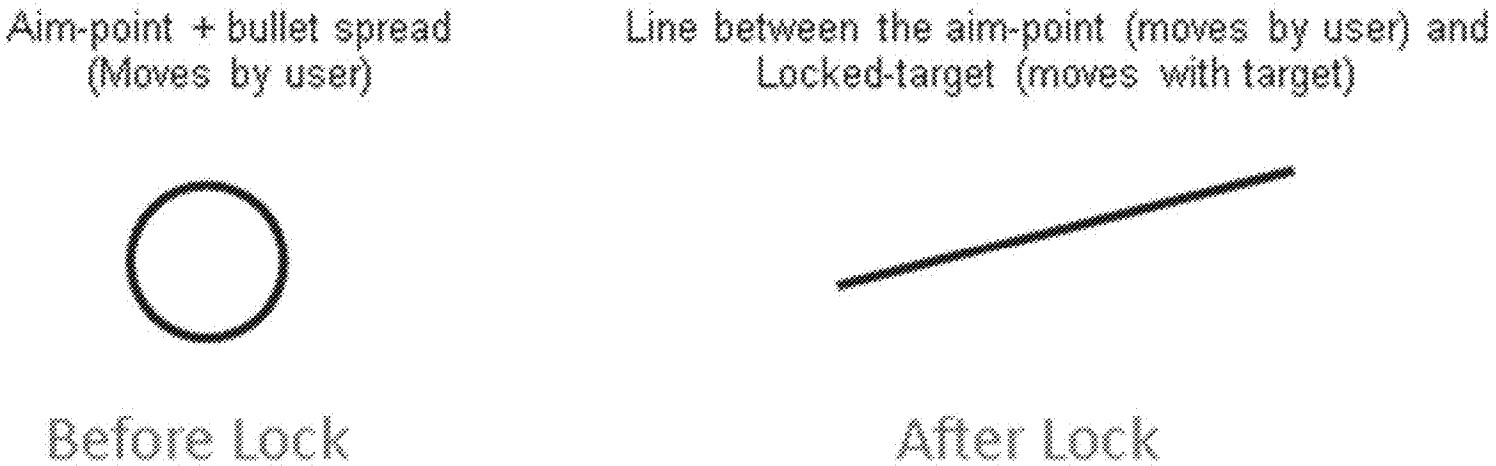
FIG. 5 is an example of a laser marker drawing before and after lock.

FIG. 5 depicts an example of a laser marker drawing before and after lock. On the left side of the Figure, the pointing laser draws a circle (which roughly denotes the size of the potential bullet spread) as an aiming point or location. A dynamic circle (or some other shape) emphasizes the precision of the weapon in natural way, based on the range between the user and target. The marking adds a visible dynamic that allows better detection of the marker by the user (it is easier to see a circle than a dot). Once the target is locked (e.g. in a fire control system), the system draws a line (or a circle and a line) between the lock-point on the target and the aim-point (where the firearm is currently directed). In one configuration, the "circle" remains on the target while the line is drawn constantly between the aim-point and the locked point or center of the locked-on area/object. The length and direction of the line changes as the weapon and/or target moves. The depicted markings show, in natural way, how the user needs to adjust the aim of the weapon in order to hit the target. The line is displayed on any object in between the aim point and the locked point (although the line and/or other markings may not be seen on some surfaces if they are far away).

In some embodiments, laser marking or other indicators can also show the battery status or provide a low battery indicator. In some embodiments, the indicators can include a lock status ("locked"/"not locked"). Some displays may be drawn in non-combat situations, for example against a wall or on the floor. Such displays can be used for selecting system settings and/or displaying information and the like.

Fire-Control System

In another possible configuration, the aiming system is integrated into a larger fire-control system. One example of a firing control system is a system that controls when a firearm is discharged. Such a system detects and locks onto a target, even when the firearm is not pointing at the exact location of the target. Once the target is acquired, or locked onto, then the system waits for the firearm to be correctly oriented and positioned (direction, elevation etc.) before allowing the firearm to discharge. In practice, for example, a soldier will hold down the trigger once the target is acquired, but the weapon will only discharge when the weapon is pointing in the right direction. The onboard computer or controller works out an optimal firing solution before discharging the weapon. The controller needs to not only be aware of the relative position of the firearm to the target, but, in optimal circumstances, also take into account factors such as distance, angle incline (ballistics), wind, air-pressure as well as the involuntary movement of the firearm itself (because of the user's shaking hands and other involuntary movements), even when correctly aimed at the target.

As an aside, the only place where the average individual is able to successfully hit a target is at a shooting range. On the police force, for example, statistics show that most of the rounds discharged in live-fire situation miss the intended mark. In combat, the vast majority of weapons fire misses the intended target. Physical exertion, elevated adrenaline and stress levels cause the hands and body to move involuntarily and shake. The movement and shaking throws off the user's aim and is one of the main reasons for not being able to hit a target in real-life situations. A high-grade firing-control system is able to take these and other factors into consideration when calculating a firing solution.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A laser system operationally coupled to an aimable device having a Line of Sight (LOS), the system adapted for providing a graphic laser display, the system comprising:

(a) at least one laser source adapted to generate:

(i) a first laser output, said first laser output displaying a fixed pattern at a hit point having a fixed orientation relative to an axis of the LOS of the aimable device, and (ii) and a second laser output, said second laser output forming the graphic laser display;

(b) a motion control mechanism adapted to direct at least said second laser output;

(c) a tracking system configured to track at least one target; and (d) a processing unit, said processing unit configured to receive tracking data relating to a location of said at least one target relative to the LOS of the aimable device and instruct said motion control mechanism to direct said second laser output to display the graphic laser display on said at least one target.

2. The system of claim 1, wherein said at least one laser source further includes a second laser source, wherein said second laser output is generated by said second laser source.

3. The system of claim 2, wherein said motion control mechanism controls motion of said second laser source.

4. The system of claim 2, wherein said first laser output is selected from the group including: a laser having a first visible color, a near infrared laser and an infrared laser; and said second laser output selected from the group including: said laser having said first visible color, a laser having a second visible color different from said first color, a near infrared laser and an infrared laser.

5. The system of claim 1, further comprising a mirror, said mirror directed by said motion control mechanism to reflect at least said second laser output to form the graphic laser display.

6. The system of claim 5, wherein said processing unit further instructs said motion control device to direct said mirror to reflect said first laser output to display said laser dot hit point.

7. The system of claim 5, further comprising a beam splitting mechanism, said beam splitting mechanism adapted to split a laser output from said at least one laser source into said first laser output and said second laser output.

8. The system of claim 1, wherein said tracking system comprises: an imaging devise and an imaging processer, said imaging device captures images of a Field of View (FOV) of said imaging device and said imaging processor is configured to process said images so as to generate said tracking data relating to said at least one target in said FOV.

9. The system of claim 8, wherein said processing unit is configured to calculate a range to said at least one target by calculating a difference between a movement angle of said motion control mechanism for each pixel of one of said images.

10. The system of claim 1, further comprising a laser receiver for said second laser output, said laser receiver adapted to measure a distance between the aimable device and said at least one target.

11. The system of claim 1, wherein said tracking system is zeroed to the LOS of the aimable device at said distance measured by said laser receiver.

12. The system of claim 1, wherein said processing unit is further configured to calculate a target area within said at least one target, such that a projectile discharged when aimed at said target area will hit said at least one target.

13. The system of claim 1, wherein the graphic laser display further indicates an aiming correction that needs to be made in order for the LOS of the aimable device to coincide with said location of said at least one target tracked by said tracking system.

14. The system of claim 1 wherein the graphic laser display displays elements selected from the group including: boundaries of said at least one target, additional user information, a predetermined graphic indicating friendly forces, navigational instructions.

15. The system of claim 1, wherein the graphic laser display is calculated taking into account ballistic correct of a projection fired from the aimable device.

16. The system of claim 1, wherein said at least one laser source further includes an additional laser source, wherein said at least one laser source and said additional laser source are adapted to output laser beams selected from the group including: visible laser beams, Infrared laser beams and Near Infrared laser beams.

17. The system of claim 16, wherein said laser sources are selectably interchangeable.

18. The system of claim 1, wherein said tracking system includes motion sensors providing motion data relating to motion of the aimable device.

19. The system of claim 1, further comprising an indicator indicating whether the LOS of the aimable device coincides with said location of said at least one target tracked by said tracking system.

20. A fire-control system, for an aimable device, the fire-control system comprising:

(a) the aiming system of claim 1, and (b) a firing-control mechanism, controlled by the aiming system.

* * * * *